US011640131B2

(12) United States Patent
Nishioka

(10) Patent No.: US 11,640,131 B2
(45) Date of Patent: May 2, 2023

(54) FIXING DEVICE INCLUDING INSULATING MEMBER WITH SLIT FORMED WITH PROJECTION PROJECTING FROM ONE END SURFACE TOWARD THE OTHER OF SLIT, AND IMAGE FORMING APPARATUS WITH FIXING DEVICE

(71) Applicant: KYOCERA Document Solutions Inc., Osaka (JP)

(72) Inventor: Nobuhiro Nishioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/696,732

(22) Filed: Mar. 16, 2022

(65) Prior Publication Data

US 2022/0299921 A1 Sep. 22, 2022

(30) Foreign Application Priority Data

Mar. 22, 2021 (JP) ..... JP2021-046990

(51) Int. Cl.
*G03G 15/20* (2006.01)

(52) U.S. Cl.
CPC ..... *G03G 15/2064* (2013.01)

(58) Field of Classification Search
CPC ..... G03G 15/2064
See application file for complete search history.

(56) References Cited

U.S. PATENT DOCUMENTS 1,770,034 A * 7/1930 Hardy ..... F16J 9/08 277/467
6,390,683 B1 * 5/2002 Hirose ..... F16C 19/525 384/277
2012/0183246 A1 * 7/2012 Oki ..... F16C 33/128 384/276
2017/0168436 A1 * 6/2017 Ogino ..... B65H 27/00

FOREIGN PATENT DOCUMENTS

DE 102011082809 A1 * 3/2013 ..... B25B 27/0035
JP 2001056020 A 2/2001
JP 5762698 B2 * 8/2015 ..... F16C 19/463

* cited by examiner

*Primary Examiner* — Sevan A Aydin
(74) *Attorney, Agent, or Firm* — IP Business Solutions, LLC

(57) ABSTRACT

A fixing device includes a fixing roller, a pressure roller, a first bearing, a second bearing, and an annular insulating member. The insulating member is interposed at least one of between the first bearing and a shaft of the fixing roller and between the second bearing and a shaft of the pressure roller. The insulating member has a slit formed in at least one circumferential location thereon and creating a circumferential discontinuity in the insulating member, and includes a projection projecting from one of circumferentially opposed end surfaces of the slit toward the other of the circumferentially opposed end surfaces.

11 Claims, 4 Drawing Sheets

FIXING DEVICE INCLUDING INSULATING MEMBER WITH SLIT FORMED WITH PROJECTION PROJECTING FROM ONE END SURFACE TOWARD THE OTHER OF SLIT, AND IMAGE FORMING APPARATUS WITH FIXING DEVICE

INCORPORATION BY REFERENCE

This application claims priority to Japanese Patent Application No. 2021-046990 filed on 22 Mar. 2021, the entire contents of which are incorporated by reference herein.

BACKGROUND

The present disclosure relates to fixing devices and image forming apparatuses equipped with fixing devices.

Generally, a fixing device is known that includes a fixing roller capable of being heated by a heating part and a pressure roller pressed against the fixing roller and fixes a toner image on a sheet by allowing the sheet to pass through a nip formed between both the rollers. In relation to such a general fixing device, there is known a technique in which an annular insulating member is disposed between a shaft of the fixing roller and a bearing supporting the shaft. There is also known a technique in which an insulating member is further provided between a shaft of the pressure roller and a bearing supporting the shaft.

The insulating member has a slit formed widthwise at a circumferential location on the insulating member in order to prevent backlash of the fixing roller due to breakage of the insulating member caused by thermal expansion and contraction of the fixing roller. Thus, the insulating member has a circumferential discontinuity created by the slit.

SUMMARY

A technique improved over the aforementioned techniques is proposed as one aspect of the present disclosure.

A fixing device according to an aspect of the present disclosure includes a fixing roller, a pressure roller, a first bearing, a second bearing, and an annular insulating member. The fixing roller includes a heating part and is capable of being heated by the heating part. The pressure roller is pressed against the fixing roller. The first bearing supports a shaft of the fixing roller to allow rotation of the shaft of the fixing roller. The second bearing supports a shaft of the pressure roller to allow rotation of the shaft of the pressure roller. The insulating member is interposed at least one of between the first bearing and the shaft of the fixing roller and between the second bearing and the shaft of the pressure roller. The insulating member has a slit formed in at least one circumferential location thereon and creating a circumferential discontinuity in the insulating member, and includes a projection projecting from one of circumferentially opposed end surfaces of the slit toward the other of the circumferentially opposed end surfaces.

An image forming apparatus according to another aspect of the present disclosure includes the above-described fixing device and an image forming device. The image forming device forms an image on a recording medium.

DETAILED DESCRIPTION

Hereinafter, a description will be given of an embodiment of the present disclosure with reference to the drawings. However, the present disclosure is not limited to the following embodiment.

<Image Forming Apparatus>

Figure 1:
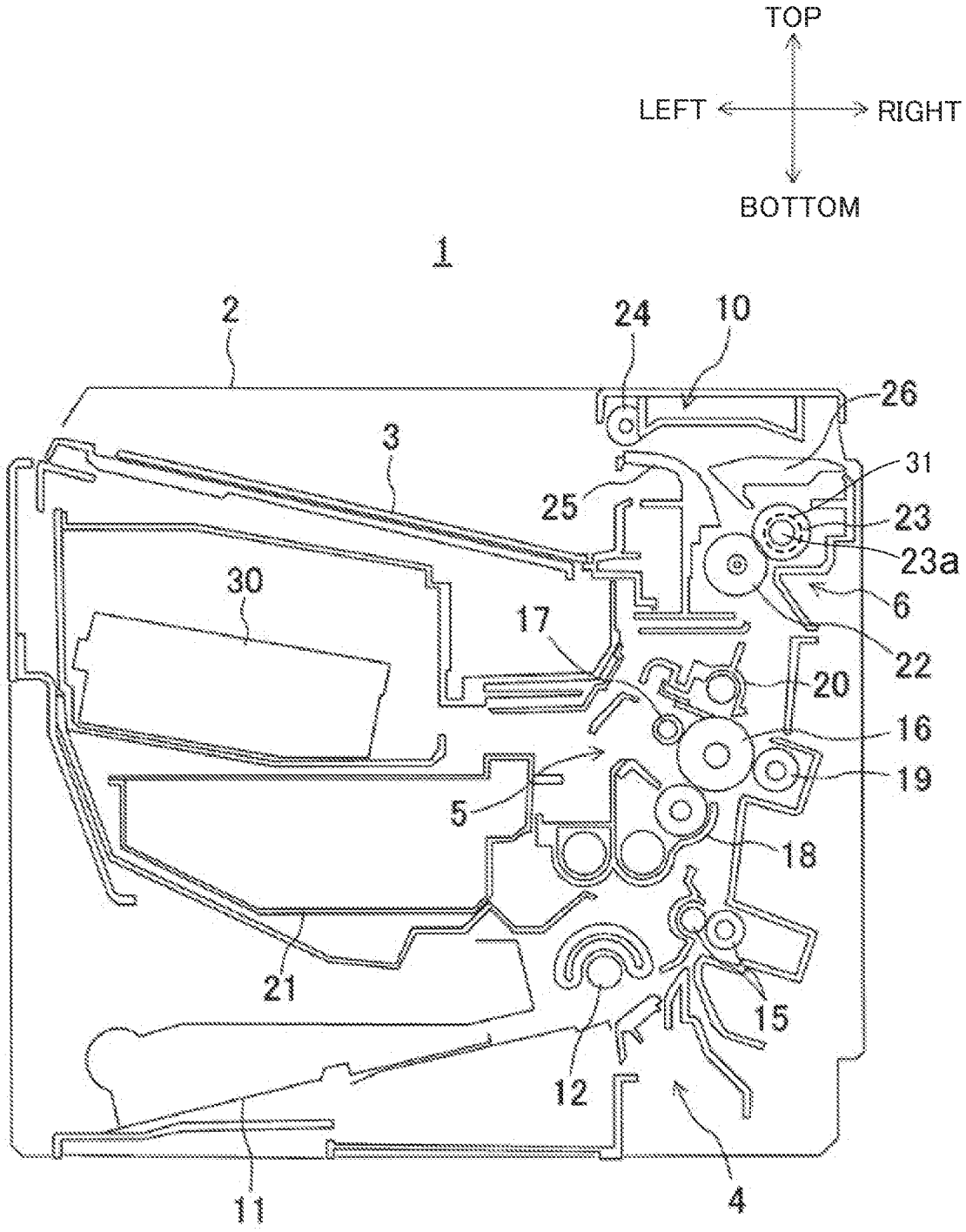
FIG. 1 is a cross-sectional view showing a schematic structure of an image forming apparatus according to an embodiment of the present disclosure.

FIG. 1 is a cross-sectional view showing a schematic structure of an image forming apparatus 1 according to one embodiment of the present disclosure.

As shown in FIG. 1, the image forming apparatus 1 includes a box-shaped apparatus body 2, a cassette sheet feeder 4, an image forming device 5, an fixing device 6, and a sheet output device 10. The image forming apparatus 1 conveys a sheet as a recording medium along a conveyance path in the apparatus body 2 and forms, in the course of conveyance of the sheet, a toner image on the sheet based on image data sent from a terminal device or the like.

The cassette sheet feeder 4 is provided at the bottom of the apparatus body 2. The cassette sheet feeder 4 includes: a sheet feed cassette 11 containing a plurality of sheets stacked one on another; and a pick-up roller 12 capable of picking up the sheets in the sheet feed cassette 11 sheet by sheet.

The image forming device 5 is provided above the cassette sheet feeder 4 in the interior of the apparatus body 2. The image forming device 5 includes: a photosensitive drum 16 as an image carrier rotatably provided in the apparatus body 2; a charging roller 17 disposed next to the photosensitive drum 16; a developing device 18, a transfer roller 19, a cleaning device 20, and an optical scanning device 30 disposed lateral to the photosensitive drum 16. The image forming device 5 forms an image on a sheet fed from the cassette sheet feeder 4.

In the conveyance path, a pair of registration rollers 15 are provided to temporarily keep the sheet fed from the sheet feed cassette 11 near the image forming device 5 and then feed the sheet forward to the image forming device 5 with a predetermined timing.

The fixing device 6 is disposed above the image forming device 5. The fixing device 6 includes a fixing roller 22 and a pressure roller 23 which rotate while being pressed against each other. The fixing device 6 fixes the toner image transferred to the sheet by the image forming device 5 on the sheet.

The sheet output device 10 is provided obliquely above the fixing device 6. The sheet output device 10 includes a sheet output tray 3, a sheet output roller 24 that conveys a sheet to the sheet output tray 3, and a conveyance guide rib 25 that guides the sheet to the sheet output roller 24. The sheet output tray 3 is formed in a depressed shape on the top of the apparatus body 2.

When the image forming apparatus 1 receives image data, the photosensitive drum 16 of the image forming device 5 is driven into rotation and the charging roller 17 thereof electrically charges the surface of the photosensitive drum 16.

Subsequently, the optical scanning device 30 emits laser light to the photosensitive drum 16 based on the image data. When the laser light is applied to the surface of the photosensitive drum 16, an electrostatic latent image is formed on the surface of the photosensitive drum 16. Meanwhile, a toner is supplied from a toner container 21 to the developing device 18. The electrostatic latent image formed on the photosensitive drum 16 is developed into a visible image as a toner image by the developing device 18.

Subsequently, the sheet passes between the transfer roller 19 and the photosensitive drum 16. In doing so, the toner image on the photosensitive drum 16 is transferred to the sheet by a transfer bias transferred to the transfer roller 19. The sheet having the toner image transferred thereto is subjected to heat and pressure by the fixing roller 22 and the pressure roller 23 in the fixing device 6. As a result, the toner image is fixed on the sheet.

<Fixing Device>

The fixing device 6 includes the fixing roller 22, the pressure roller 23, and a housing 26. The housing 26 has an approximately cuboidal shape elongated in a front-to-rear direction. The fixing roller 22 and the pressure roller 23 are accommodated in the housing 26 to extend in the front-to-rear direction.

Figure 2:
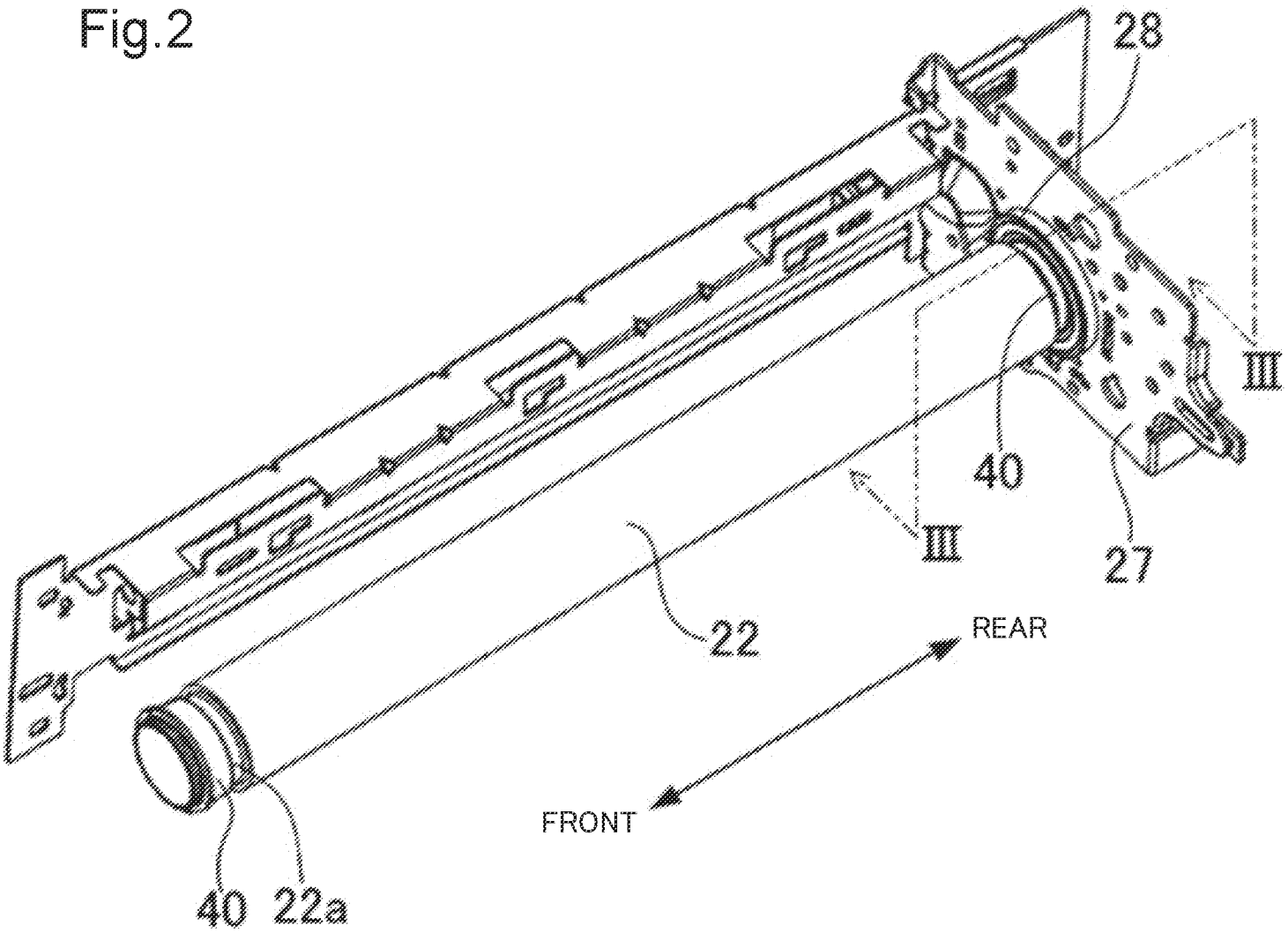
FIG. 2 is a perspective view showing a fixing roller and a sheet-metal frame supporting the fixing roller.

As shown in FIG. 2, the fixing roller 22 is rotatably supported through bearings 28 (an example of the first bearing) by a pair of sheet-metal frames 27 provided in the housing 26. Although in FIG. 2 the pressure roller 23 (shown only in FIG. 1) is omitted and unshown, it is actually disposed at the upper right of the fixing roller 22.

Figure 3:
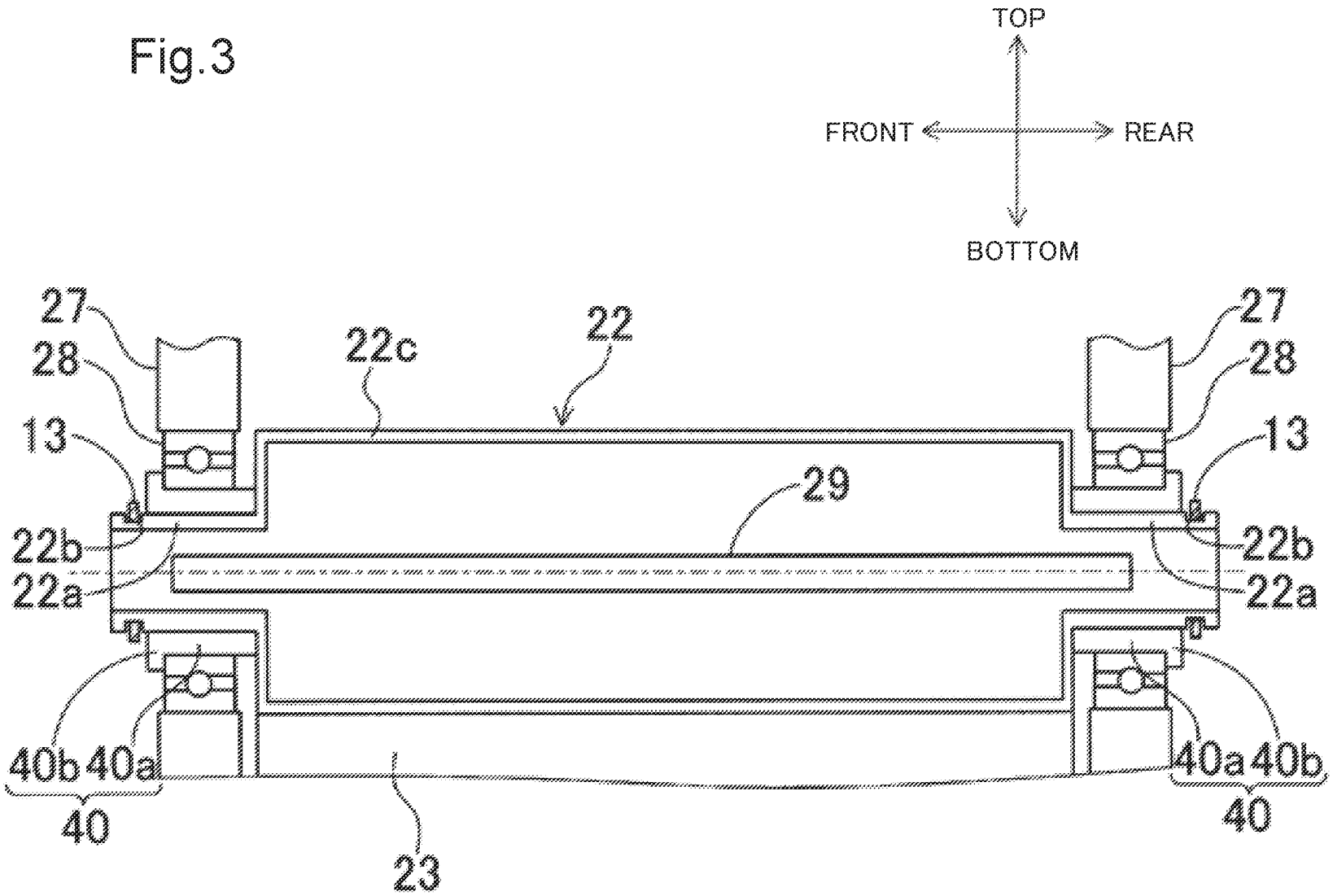
FIG. 3 is a cross-sectional view taken along the line in FIG. 2.

As shown in FIG. 3, the fixing roller 22 includes a cylindrical core 22*c*, a releasable layer provided on the outer periphery of the core 22*c* with an adhesive layer in between, and shafts 22*a* protruding from both axial end surfaces of the cylindrical core 22*c*. The fixing roller 22 is internally provided with a halogen heater 29 (an example of the heating part). The halogen heater 29 emits radiation heat to the inner periphery of the fixing roller 22 to heat the fixing roller 22. The shafts 22*a* of the fixing roller 22 are rotatably supported by respective bearings 28 attached to the pair of sheet-metal frames 27. In this example, the bearings 28 are rolling bearings and are fixed by press fitting to respective attachment holes formed in the sheet-metal frames 27.

An insulating member 40 is interposed between each of the shafts 22*a* of the fixing roller 22 and the associated bearing 28. The fixing roller 22 is driven into rotation counterclockwise in FIGS. 1 and 2 by a motor. The pressure roller 23 includes a shaft 23*a*, an elastic layer provided on the outer periphery of the shaft 23*a*, and a releasable layer provided on the outer periphery of the elastic layer with an adhesive layer in between. The shaft 23*a* of the pressure roller 23 is rotatably supported at both ends by respective bearings 31 attached to the pair of sheet-metal frames 27. The pressure roller 23 is pressed against the fixing roller 22 by a biasing mechanism. The pressure roller 23 and the fixing roller 22 form a nip therebetween through which a sheet is passed.

[Structure of Insulating Member]

Figure 4:
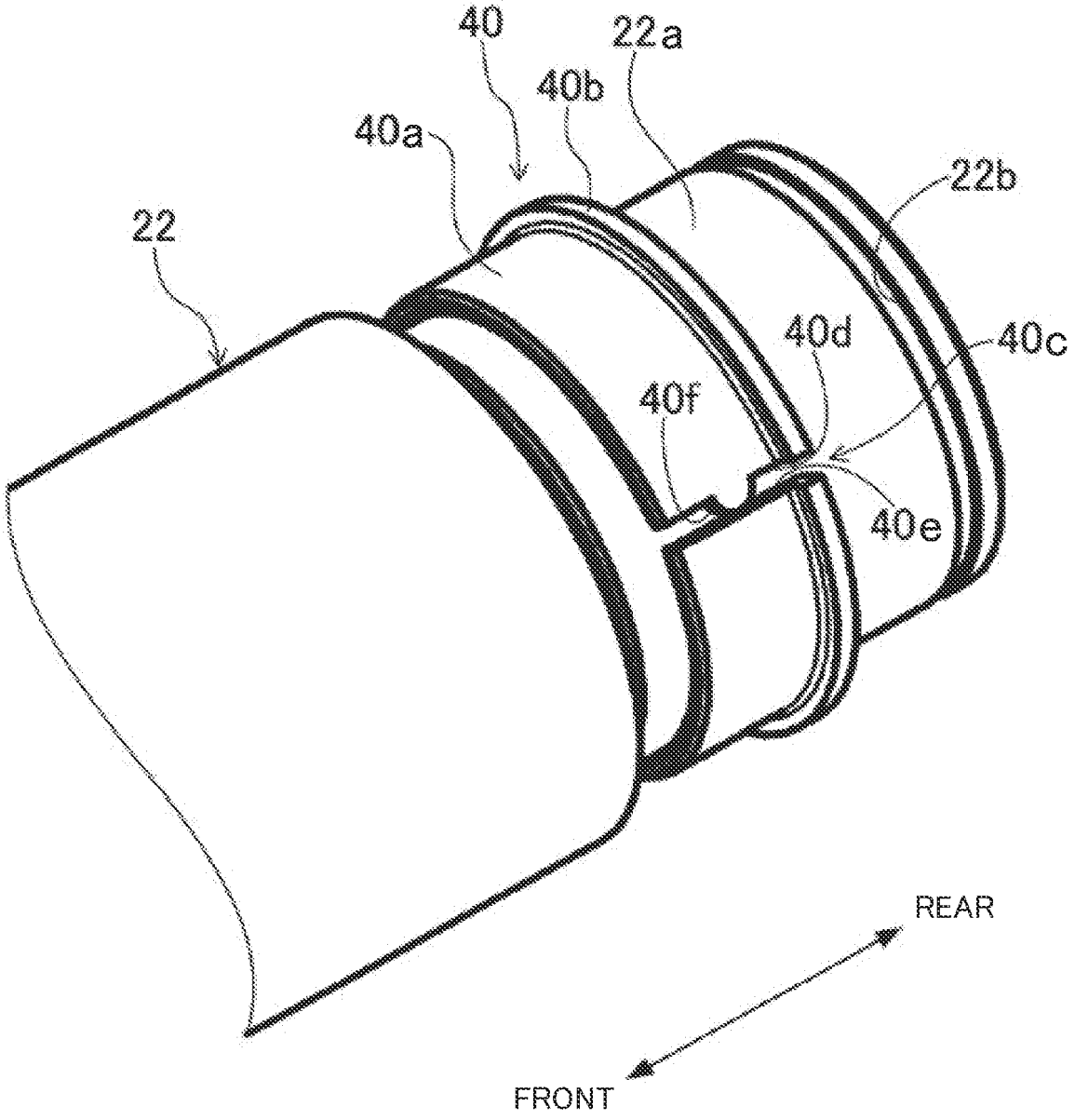
FIG. 4 is a perspective view showing an insulating member fitted around one end portion of the fixing roller.

As shown in FIG. 4, each of the insulating members 40 is made of, for example, PPS (polyphenylene sulfide) or PEEK (polyether ether ketone). The insulating member 40 includes: a cylindrical sleeve 40*a* fitted on the shaft 22*a* of the fixing roller 22; and a flange 40*b* extending radially outward from one axial end of the sleeve 40*a*.

As shown in FIG. 3, abutment of the flanges 40*b* on the end surfaces of the bearings 28 restricts axially inward movement of the fixing roller 22. An annular groove 22*b* is formed in each of the shafts 22*a* of the fixing roller 22 and a C-ring 13 is fitted into the annular groove 22*b*. The C-ring 13 restricts axially outward movement of the associated insulating member 40.

The cylindrical sleeve 40*a* of the insulating member 40 has a slit 40*c* formed to extend in the axial direction. Thus, the insulating member 40 has a circumferential discontinuity created by the slit 40*c*. A projection 40*f* is formed on one end surface 40*d* of both opposed end surfaces 40*d* and 40*e* of the slit 40*c* (in this example, the end surface 40*d* thereof located downstream in a direction of rotation of the fixing roller 22).

The projection 40*f* projects from the one end surface 40*d* toward the other end surface 40*e*. In this example, the projection 40*f* has a semicircular disc shape as viewed in a radial direction of the fixing roller 22. The projection 40*f* is formed on a central portion of the one end surface 40*d* in a direction along the roller axis (in the axial direction of the fixing roller 22). A projecting top surface of the projection 40*f* (i.e., an end surface of the projection 40*f* formed in the shape of a cylindrical surface) abuts on the other end surface 40*e* of the slit 40*c* in a normal temperature condition before the halogen heater 29 is operated.

Effects

The general fixing device described previously has a problem in that, during rotation of the fixing roller, both the opposed end surfaces of the insulating member with a slit in between rub against each other and thus generate abnormal noise. Specifically, when the amount of thermal expansion of the fixing roller is sufficiently large, both the end surface of the slit come into close contact with each other and, therefore, generate no abnormal noise. However, when the temperature of the fixing roller is relatively low, i.e., when the amount of thermal expansion of the fixing roller is relatively small and the width of the slit in the insulating member becomes narrow, both the end surfaces of the slit may butt against each other during rotation of the fixing roller and, therefore, are likely to rub against each other, which makes the above problem particularly significant.

To cope with the above problem, in this embodiment, the insulating member 40 has a slit 40*c* formed in at least one circumferential location thereon and creating a circumferential discontinuity in the insulating member 40. The insulating member 40 includes a projection 40*f* formed on one end surface 40*d* of circumferentially opposed end surfaces 40*d* and 40*e* of the slit 40*c* and projecting toward the other end surface 40*e*.

In this structure, since the slit 40*c* is formed in the insulating member 40, backlash in the shafts 22*a* of the fixing roller 22 due to thermal expansion and contraction can be reduced. In addition, since the projection 40*f* is formed on the one end surface 40*d* of the slit 40*c*, this minimizes the area where both the end surfaces 40*d* and 40*e* opposed with the slit 40*c* in between rub against each other during rotation of the fixing roller 22. As a result, the occurrence of abnormal noise due to rubbing of both the end surfaces 40*d* and 40*e* can be reduced.

Furthermore, in this embodiment, the projection 40*f* is formed to make line contact with the other end surface 40*d* of the slit 40*c*.

In this structure, when the amount of thermal expansion of the fixing roller 22 is relatively small and the width of the slit 40*c* in the insulating member 40 becomes narrow, the projection 40*f* and the other end surface 40*d* of the slit 40*c* are the first to make contact with each other. Therefore, the area of contact between the one end surface 40*d* and the other end surface 40*e* of the slit 40*c* can be reduced as much as possible. As a result, the occurrence of abnormal noise can be more certainly reduced.

Specifically, the projection 40*f* is formed with the shape of a cylindrical surface to allow line contact with the other end surface 40*e* of the slit 40*c*.

In this structure, the projection 40*f* can be prevented from making edge contact with the other end surface 40*e* of the slit 40*c*. As a result, the occurrence of abnormal noise can be more certainly reduced.

In this embodiment, the projection 40*f* is formed on the central portion of the one end surface 40*d* of the slit 40*c* in the axial direction of the fixing roller 22.

In this structure, the shape of the slit 40*c* can be always held in a rectangular shape extending in the axial direction of the fixing roller 22. As a result, it can be avoided that, for example, the slit 40*c* deforms in a V-shape to invite edge contact which is widespread contact between the one end surface 40*d* and the other end surface 40*e*.

In this embodiment, the image forming apparatus 1 includes the fixing device 6 and the image forming device 5.

In this structure, it can be prevented that abnormal noise is caused by rubbing of both the end surfaces 40*d* and 40*e* of the slit 40*c* in the insulating member 40 after the image forming apparatus 1 is started up and, particularly, before the temperature of the fixing roller 22 sufficiently increases. As a result, it can be avoided that the user hears abnormal noise due to rubbing of the insulating member 40 and is thus misled into thinking that a failure has occurred.

Other Embodiments

Although in the above embodiment the insulating member 40 is provided between each of the shafts 22*a* of the fixing roller 22 and the bearing 28, the present disclosure is not limited to the manner described in the above embodiment. The insulating member 40 is sufficient to be provided at least one of between the fixing roller 22 and the bearing 28 and between the shaft 23*a* of the pressure roller 23 and the bearing 31 (corresponding to the second bearing). Although in the above embodiment the number of slits 40*c* provided is one, the number of slits 40*c* may be two or more. In this case, the insulating member 40 has a plurality of discontinuities, but the present disclosure can also be applied to this structure.

Although in the above embodiment the projection 40*f* formed on one end surface 40*d* of the slit 40*c* in the insulating member 40 is formed to make line contact with the other end surface 40*e*, the present disclosure is not limited to the manner described in the above embodiment. For example, the projection 40*f* may be formed to make point contact with the other end surface 40*e*. In this case, the end surface of the projection 40*f* is preferably formed in a spherical shape. Thus, the contact area between the projection 40*f* and the other end surface 40*e* can be minimized to reduce the occurrence of abnormal noise.

Although in the above embodiment the end surface (the one end surface 40*d*) of the slit 40*c* on which the projection 40*f* is formed is located downstream of the other end surface 40*e* in the direction of rotation of the fixing roller 22, the present disclosure is not limited to the manner described in the above embodiment. For example, the end surface of the slit 40*c* having the projection 40*f* may be located upstream of the other end surface 40*e* in the direction of rotation of the fixing roller 22.

INDUSTRIAL APPLICABILITY

As seen from the above, the present disclosure is useful for a fixing device and an image forming apparatus equipped with a fixing device and particularly useful for applying to an image forming apparatus, such as a printer, a facsimile machine or a multifunction peripheral (MFP).

While the present disclosure has been described in detail with reference to the embodiments thereof, it would be apparent to those skilled in the art the various changes and modifications may be made therein within the scope defined by the appended claims.

What is claimed is:

1. A fixing device comprising:

a fixing roller including a heating part and capable of being heated by the heating part;

a pressure roller pressed against the fixing roller;

a first bearing that supports a shaft of the fixing roller to allow rotation of the shaft of the fixing roller;

a second bearing that supports a shaft of the pressure roller to allow rotation of the shaft of the pressure roller; and an annular insulating member interposed at least one of between the first bearing and the shaft of the fixing roller and between the second bearing and the shaft of the pressure roller, wherein the insulating member has a slit formed in at least one circumferential location thereon and extending straight in an axis direction of the shafts, and creates a circumferential discontinuity in the insulating member, and the insulating member includes one projection projecting in a circumferential direction of the insulating member from one of circumferentially opposed end surfaces of the slit toward the other of the circumferentially opposed end surfaces and interposed between the one of circumferentially opposed end surfaces of the slit and the other of the circumferentially opposed end surfaces.

2. The fixing device according to claim 1, wherein the projection is formed to make line contact with the other end surface formed flatly of the slit.

3. The fixing device according to claim 1, wherein the projection has an end surface formed in a cylindrical shape.

4. The fixing device according to claim 1, wherein the projection is formed to make point contact with the other end surface of the slit.

5. The fixing device according to claim 4, wherein the projection has an end surface formed in a spherical shape.

6. The fixing device according to claim 4, wherein the projection is formed on a central portion of the one end surface of the slit in an axial direction of the fixing roller.

7. The fixing device according to claim 4, wherein the one end surface of the slit is located downstream of the other end surface of the slit in a direction of rotation of the fixing roller.

8. An image forming apparatus comprising:

the fixing device according to claim 4; and an image forming device that forms an image on a recording medium.

9. The fixing device according to claim 1, wherein the projection is formed on a central portion of the one end surface of the slit in an axial direction of the fixing roller.

10. The fixing device according to claim 1, wherein the one end surface of the slit is located downstream of the other end surface of the slit in a direction of rotation of the fixing roller.

11. An image forming apparatus comprising:

the fixing device according to claim 1; and an image forming device that forms an image on a recording medium.

* * * * *